US007208098B2

(12) United States Patent
Li et al.

(10) Patent No.: US 7,208,098 B2
(45) Date of Patent: Apr. 24, 2007

(54) LUBRICATING COMPOSITION CONTAINING A BLEND OF A POLYOL ESTER AND AN ALKYLBENZENE

(75) Inventors: Hsinheng Li, Midland, MI (US); Kenneth C. Lilje, Midland, MI (US)

(73) Assignee: The Lubrizol Corporation, Wickliffe, OH (US)

( * ) Notice: Subject to any disclaimer, the term of this patent is extended or adjusted under 35 U.S.C. 154(b) by 75 days.

(21) Appl. No.: 10/495,887

(22) PCT Filed: Nov. 13, 2002

(86) PCT No.: PCT/US02/37315

§ 371 (c)(1),
(2), (4) Date: Oct. 1, 2004

(87) PCT Pub. No.: WO03/044137

PCT Pub. Date: May 30, 2003

(65) Prior Publication Data

US 2005/0029488 A1 Feb. 10, 2005

Related U.S. Application Data

(60) Provisional application No. 60/388,595, filed on Jun. 13, 2002, provisional application No. 60/332,710, filed on Nov. 19, 2001.

(51) Int. Cl.
*C09K 5/04* (2006.01)

(52) U.S. Cl. ..... 252/68

(58) Field of Classification Search ..... None
See application file for complete search history.

(56) References Cited

U.S. PATENT DOCUMENTS

| | | | | |
|---|---|---|---|---|
| 5,342,533 | A | 8/1994 | Kondo et al. | 252/68 |
| 6,251,300 | B1 | 6/2001 | Takigawa et al. | 252/67 |

FOREIGN PATENT DOCUMENTS

| | | | |
|---|---|---|---|
| EP | 556662 | A1 * | 8/1993 |
| EP | 699742 | A2 * | 3/1996 |
| EP | 1085077 | A1 | 3/2001 |
| WO | WO 02/070637 | A1 | 9/2002 |

OTHER PUBLICATIONS

Derwent Abstract Accession No. 1993-200714/199325 (Japanese Patent No. 5125374A, Sanyo Electric Co.).
Derwent Abstract Accession No. 1997-347719/199732 (Japanese Patent No. 9143486A, Matsushita Denki Sangyo KK).
Search Report from counterpart PCT Publication WO 03/044137 A3 published Aug. 7, 2003.

* cited by examiner

*Primary Examiner*—John R. Hardee
(74) *Attorney, Agent, or Firm*—Samuel B. Laferty; Michael F. Esposito

(57) ABSTRACT

The present invention relates to a lubricating basestock for the blends of hydrofluorocarbon and optionally hydrochlorofluorocarbon refrigerants comprising a blend of (A) at least one alkylbenzene and (B) at least one polyol ester. While alkylbenzenes are not miscible with the refrigerant blend at the desired operating temperature and pressure of refrigeration or air-conditioning systems, the addition of low concentration of polyol ester is found to greatly improve the miscibility of the alkylbenzene and polyol ester blend. An important criteria of the invention is that the lubricant blend of polyol ester and alkylbenzene are sufficiently miscible with the hydrofluorocarbon refrigerant blend both as a liquid and a gaseous refrigerant over the operational temperatures of the compression refrigeration system.

9 Claims, No Drawings

LUBRICATING COMPOSITION CONTAINING A BLEND OF A POLYOL ESTER AND AN ALKYLBENZENE

This application claims the benefit of U.S. Provisional Application No. 60/332,710 filed Nov. 19, 2001 and of U.S. Provisional Application No. 60/388,595 filed Jun. 13, 2002.

FIELD OF INVENTION

The present invention relates to a lubricating composition for compression refrigeration containing a blend of a polyol ester and a specific alkylbenzenes. In a preferred embodiment, the alkylbenzene is a narrow group of branched or linear alkyl substituted benzene having a specific range of viscosity in combination with a polyol ester having good miscibility with hydrofluorocarbon refrigerants. The blend of polyol ester and alkylbenzene can be used with or without additives including other oils of lubricating viscosity to form the lubricating composition. The compositions are useful with a positive displacement compressor, such as a reciprocating rotary vane, scroll, or rotary screw air compressor.

BACKGROUND OF THE INVENTION

Lubricating oils have been used in the past to lubricate the bearings of positive displacement compressors, to seal the rotors, and to cool the compressed gases. Lubricating oils typically used in the industry comprise a mineral oil or synthetic oil as a base oil along with various additives for a particular purpose. Thermal and oxidative stability and varnish and deposit control are some of the important properties desirable in a lubricant for maximizing the life of the lubricant, and hence, the life of the equipment, especially under the high temperature and pressure conditions created when operating a positive displacement compressor, such as a reciprocating rotary vane, scroll, or rotary screw compressor.

It has also been desirable in the industry to provide a lubricating composition that does not deteriorate due to exposure to moisture, exposure to high temperatures or use for an extended period of time. Hydrocarbon oils have very good resistance to reactions with moisture. Polyol esters have good high temperature resistance, but lesser stability to reactions with water.

U.S. Pat. No. 4,046,533 teaches branched chain alkylbenzenes can be used as lubricants for refrigerants comprising halo-substituted hydrocarbons of 1 to 3 carbon atoms and at least 40% by weight fluorine. In column 2, line 30, through column 3 line 50 it details how to identify alkylbenzenes with high amounts of branching in the alkyl group and how to identify the halo-substituted hydrocarbons. The examples of the halo-substituted hydrocarbons all contain chlorine atoms.

U.S. Pat. No. 4,302,343 describes esters of hindered polyhydric alcohols having 3 to 8 hydroxyl groups and 5 to 10 carbon atoms with one or more alkanoic acids having 4 to 18 carbon atoms. The lubricant of this patent is a blend of these esters with polyether polyols. The lubricant is used for rotary screw compressors.

U.S. Pat. No. 4,755,316 describes polyalkylene glycol lubricants to be used with a new refrigerant R-134 (tetrafluoroethane) developed to minimize concerns over ozone depletion by the halo-fluorocarbons. The patent discusses that mineral oil, a conventional lubricant with R-12 is not miscible with R134a and thus a search was made for lubricating oils meeting all of the requirements of compression refrigeration along with miscibility with R134a.

EPO 422 185B published to the Lubrizol Corporation for the use of polyol esters with hydrofluorocarbon lubricants such as R134a. The preferred polyol esters in this application were those soluble with hydrofluorocarbon lubricants over the operational range of the working fluids in a compression refrigeration system. This application outlined how to select different polyol esters to obtain miscibility with R134a and other properties.

U.S. Pat. No. 5,342,533 describes refrigerator oil compositions for compressors that include hydrofluorocarbons and the carboxylates of polyhydric alcohols described in U.S. Pat. No. 4,302,343 and EPO 422 185B. U.S. Pat. No. 5,342,533 also included a phosphate or phosphite in the lubricants and optionally included small amounts of mineral oil and/or alkylbenzene.

U.S. Pat. Nos. 6,207,071 and 6,252,300 relate to alkylbenzenes of 200 to 350 molecular weight used in compression refrigeration systems with R134a and/or R125. The application shows that lubricant compositions predominantly of alkylbenzenes cause seizure of the compressor parts after extended use if the molecular weight of 60% of the alkylbenzenes does not fall within these ranges. A phosphorus compound is optionally included in the lubricant.

SUMMARY OF THE INVENTION

The present invention relates to a lubricating fluid comprising a blend of polyol esters and alkylbenzenes having low viscosity and highly branched alkyl groups. The lubricating fluid is different than most alkylbenzene oils or blends of alkylbenzenes with other oils because it is miscible with hydrofluorocarbon refrigerants over the operational temperature range of compression refrigeration systems for air conditioning, refrigeration, freezers etc. In embodiment A the lubricant is miscible with a refrigerant that is substantially free of chlorine or bromine containing refrigerants. In embodiment B the refrigerant may contain chlorine containing fluorocarbon refrigerant. The polyol ester provides good temperature stability, lubricity, and miscibility with the hydrofluorocarbon to the blend. The alkylbenzenes provide good temperature stability, lubricity, and decrease the water attraction and water sensitivity of the blend. Additives, such as antioxidants, corrosion inhibitors, metal passivating agents and other lubricating oils, can be added to the lubricating blend. In embodiment A, the alkylbenzene is an ISO 5 alkylbenzene predominantly with a single highly branched alkyl group of 9–15 carbon atoms per benzene ring. In a more preferred embodiment that alkyl benzene is mixed with a polyol ester from a hindered polyhydric alcohol having 2 to 6 OH groups. The blend can also be used in combination with or without additives therein.

According to the present invention, the lubricating composition exhibits low viscosity necessary for energy efficient operation, decreased attraction and sensitivity to moisture, and excellent long term stability of the lubricant.

DETAILED DESCRIPTION OF THE PREFERRED EMBODIMENTS

This disclosure will first describe an embodiment A of the invention where the refrigerant is substantially free of chlorine or bromine containing refrigerants. Embodiment A benefits from a low viscosity alkylbenzene and substantial amounts of polyol ester to achieve miscibility between the lubricant blend and the hydrofluorocarbon refrigerant. Later an embodiment B is described where the refrigerant is a blend of a hydrofluorocarbon refrigerant and a fluorochlorocarbon refrigerant. In embodiment B lower percentages of polyol ester are required and a slightly higher viscosity alkylbenzene is desirable.

Embodiment A and Lubricating Blend in General

The lubricating blend of this invention is selected components from the broader classes of polyol esters and alkylbenzenes. Polyol esters as a class of materials include esters from alcohols having 2 or more OH groups condensed with mono and/or polycarboxylic acids to form ester linkages in the reaction product. The viscosity and thermal stability of the class varies widely. The alkylbenzenes as a class of materials also varies widely including mono and polyalkyl functionalized benzenes of very low viscosity to relatively high viscosity. Alkylbenzenes include at the lower molecular weight things such as toluene that aren't typically considered as a lubricant oils and would be a gas rather than a liquid under some of the conditions in a compression refrigeration system.

An important criteria of embodiment A of the invention is that the lubricant blend of polyol ester and alkylbenzene are miscible with the selected hydrofluorocarbon refrigerant or refrigerant blend over the operational temperatures of the compression refrigeration system. Miscibility of the lubricant with the refrigerant over operational temperatures for embodiments A & B assures that the lubricant oil that might enter into the refrigeration system out of the compressor can be carried through the evaporation orifice and heat transfer equipment back to the compressor where it functions as a lubricant and that a nonmiscible lubricant portion is not present as blockage in the system restricting refrigerant movement through the system. It also assures that minimal lubricant oil films exist on the heat transfer equipment where it might interfere with the efficiency of heat transfer by acting as a thermal insulating film. While the necessary extent of miscibility of the lubricant blend and the refrigerant may vary depending upon application in embodiment A a desired range is about −20° C. to about 80° C. and more preferably −10 to about 70° C. for concentrations of 5, 10, and/or 20 weight percent lubricant in the refrigerant (which can be R134a or other hydrofluorocarbons or blends of hydrofluorocarbons).

A particular benefit of the lubricant blend is that low viscosity lubricants can be formulated that tend to increase the efficiency of the refrigeration system by minimizing energy losses. While polyol ester blends with alkylbenzenes can be formulated to a wide variety of viscosities, preferred viscosities for embodiment A for the neat lubricant blend (i.e. lubricant without additives, refrigerant, and other diluents) is from about ISO 5 to 70, more desirably from 5 to 68, more desirably 5 to 32, and preferably 5 to 15. An ISO viscosity is basically the numerical value of the viscosity in units of centistokes (cSt) of the material at 40° C.

The alkylbenzenes though not miscible with the hydrofluorocarbons, can become miscible with the hydrofluorocarbons when the alkylbenzenes are blended with the particular polyol esters of this disclosure. The polyol esters have good high temperature stability and long service life but do have sensitivity to moisture and hydrolysis to form the starting alcohols and carboxylic acids. The alkylbenzenes alone have a problem with miscibility with hydrofluorocarbons but decrease the water sensitivity of the blend.

The alkylbenzenes are desirably used in embodiment A in the blend in amounts from about 5 to about 45 weight percent, more desirably from about 10 to about 40, still more desirably from about 15 to about 35 and preferably from about 25 to about 35 weight percent of the blend of alkylbenzenes and polyol esters. The polyol esters are used in complementary amounts such as from about 55 to about 95 weight percent, desirably from about 60 to about 90, more desirably from about 65 to about 85 and preferably from about 65 to about 75 weight percent of the blend of alkylbenzenes and polyol esters. Desirably at least 80, 85, or 90 wt. % of the oils of the blend are polyol esters and alkylbenzenes described below. Other oils, components, and additives may be added to the lubricant blend to impart additional properties necessary for particular applications. Additives to alkylbenzene and to polyol ester lubricants are well known to the art.

The alkyl benzenes for embodiment A desirably have a molecular weight from about 100 to about 500 and more desirably from about 200 to about 350, and preferably from about 200 to about 300. Desirably the alkylbenzenes for embodiment A have a viscosity from about 1 to about 15 cSt at 40° C. and more desirably from about 3 to about 10 and preferably from about 3 to about 7 cSt at 40° C. Desirably in embodiment A at least 50 mole %, more desirably at least 75, and preferably at least 85 mole % of the alkylbenzene is monoalkyl substituted. Desirably in embodiment A at least 50 mole %, more desirably at least 75, and preferably at least 85 mole % of the alkyl groups of said alkylbenzene have two or more methyl and/or ethyl branches extending from the alkyl backbone. In both embodiments since the alkylbenzenes are reaction products from alkylation reactions, desirably at least 50 or 60% of the alkyl benzenes, more desirably at least 75% and preferably at least 85% have from about 5 to about 40, more desirably from about 7 to about 30, and preferably from about 8 to about 16 total carbon atoms attached to the benzene.

The polyol esters for either embodiment A or B can be selected from those taught in EPO 422 185B. Desirably the polyol esters have a number average molecular weight from about 300 to about 1000 g/mole and more desirably from about 300 to about 600. Desirably the polyol esters for embodiment A have neat viscosities (without additives or refrigerant) of from about 5 to about 70, desirably from about 5 to about 68, more desirably from about 5 to about 32 and preferably from about 5 to about 22 cSt at 40° C.

Generally alkyl branching in the polyol component and the carboxylic acid component of the ester promote better solubility with the R134a type of hydrofluorocarbon refrigerant but also increases viscosity. Lower molecular weight polyols and carboxylic acids tend to promote lower viscosities. Carboxylic acids with 4 or less carbon atoms tend to be disfavored for incorporation into the polyol esters. Carboxylic acids with more than 10 carbon atoms can only be tolerated in small amounts (e.g. less than 10 mole % based on the total carboxylic acids in the polyol ester) to maintain miscibility with the hydrofluorocarbon refrigerant at low temperatures.

The polyol esters are made by reaction polyols with carboxylic acids. Desirably the polyols have 2 to 10 hydroxyl groups per molecule and 3 to 30 carbon atoms, optionally the polyols have one or more ether linkages therein (e.g. dipentaerythritol). More desirably the polyols on average have 4–10 carbon atoms. While other heteroatoms other than C, H, and O are possible they are generally disfavored in the polyol. Preferred polyols for stability and miscibility reasons are hinder polyols and condensation products (polyethers) made from hindered polyols. The preferred number of carbon atoms from hindered polyols is from 5 to 7. Desirably at least 50 mole % and more desirably at least 80 mole % of the polyol esters are derived from reacting hindered polyols having 5 to 7 carbon atoms and having 2 to 4 OH groups. Hindered polyol esters are well known to the lubrication art. They include but are not limited to neopentyl glycol, trimethylol propane, pentaerythritol, dipentaerythritol and higher polyether oligomers of pentaerythritol. They are characterized by not having hydrogen atoms attached directly to the beta carbon (the alpha carbon being attached to the oxygen of the polyol or polyol ester (depending whether you are looking at the polyol or the polyol ester)). Instead of having hydrogen atoms attached to the beta carbon, other alkyl groups or hydroxymethyl groups are attached to the beta carbon. The use of these hindered polyols in making polyol esters has resulted in improved stability of the polyol esters. Other polyols that fall within the broader definition of polyols include ethylene glycol, diethylene glycol, glycerin, polyglycerine etc.

The carboxylic acids used to make the polyol esters are desirably primarily carboxylic acids of 5–10 carbon atoms such that at least 50 and more desirably at least 80 mole % of the polyol esters have residues (the portion of the carboxylic acid reactant incorporated into the polyol ester) of monocarboxylic acids having from 5 to 10 carbon atoms. Desirably the amount of di or higher functionality polycarboxylic acids is less than 10 mole % of the total carboxylic acid residues in the polyol ester. Small amounts of carboxylic acids (e.g. less than 10 mole % of the carboxylic acids used to make the polyol ester) can have more than 10 carbon atoms and these acid residues can contribute specific properties to the lubricant in excess to their relative number.

The lubricating blends of the present invention can also be combined with additives or both oils and additives.

Refrigerant

The refrigerant for embodiment A of this disclosure is desirably predominantly (e.g. at least 80, 90 or 95 wt. %) a hydrofluorocarbon or a blend of different hydrofluorocarbons that provide the desired properties for the particular application. Hydrofluorocarbons are defined as compounds having 1 to 5 carbon atoms, at least one hydrogen atom per molecule and at least one fluorine atom per molecule. Desirably for embodiment A the refrigerant is free of chlorine containing fluorocarbons. Hydrofluorocarbons generally do not have chlorine, bromine, or other atoms contained therein except as contaminants from manufacturing processes or handling. The hydrofluorocarbons include but are not limited to R-134a, R-125, R-32, R-143a and blends of thereof. The hydrofluorocarbons of interest in this disclosure are those having suitable vapor pressures and handling characteristics for compression refrigeration. For the purposes of this disclosure compression refrigeration will include inter alia refrigeration, air conditioning, cooling, heat pumps, etc.

Additives

As aforementioned, the lubricating blend or lubricating composition according to the present invention may also contain effective amounts of additives such as antioxidants, rust and corrosion inhibitors, metal deactivators, lubricity additives, antiwear additives, or such additives as may be required. Commercially available examples of antiwear additives are additives such as tricresyl phosphate (TCP) available at Syn-O-Add, 8484® available at Akzo-Nobel, or triphenyl phosphorothionate (TPPT) available at Ciba Geigy. In general, the finished lubricant composition will contain the additive components in minor amounts sufficient to improve the performance characteristics and properties of the oil of lubricating viscosity or basestock blend, or to both the base oil and basestock blend. Generally, additives used for their known purpose can comprise from about 10% to about 0.01% by weight of the total weight of the lubricant composition, and preferably from about 5% to about 0.001% by weight based on the total weight of the lubricating composition.

Examples of useful antioxidants include phenyl naphthyl amines (alpha and/or beta), diphenyl amines, including alkylated diphenyl amines. Commercially available examples of such antioxidants are Irganox L-57® available at Ciba Geigy, and Valube 81® available at Vanderbilt Chemical. Suitable antioxidants are also exemplified by phenolic antioxidants, aromatic amine antioxidants, sulfurized phenolic antioxidants, and organic phosphites, among others. Examples of the phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butyl-phenol), mixed methylene-bridged polyalkyl phenols, and 4,4'-thiobis(2-methyl-6-tert-butylphenol). N,N'-Di-see-butyl-p-phenylenediamine, 4-isopropylaminodiphenyl amine, phenyl-alpha-naphthyl mine, phenyl-beta-naphthyl amine, and ring-alkylated diphenylamines serve as examples of aromatic amine antioxidants. Commercially available antioxidants useful for the present invention also include Ethanox® 702 available at the Ethyl Corporation, Irganox® L-135 and Irganox® L-118, Irganox L-06® available at Ciba Geigy, and RC-7130® available at Rhein Chemie.

Examples of suitable rust and corrosion inhibitors are neutral metal sulfonates such as calcium sulfonate, magnesium sulfonate, sodium sulfonate, barium dinonylnaphthalene sulfonate, and calcium petroleum sulfonate. Other types of rust or corrosion inhibitors which may be used comprise monocarboxylic acids and polycarboxylic acids. Examples of suitable monocarboxylic acids are oleic acids and dodecanoic acid. Suitable polycarboxylic acids include dimer and trimer acids such as are produced from such acids as tall oil fatty acids, oleic acid, and linoleic acid. Also useful are carboxylic acid based, metal free materials, such as hydroxy alkyl carboxylic esters. Another useful type of rust inhibitor for use in the practice of this invention is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having about 8 to about 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; and aminosuccinic acids or derivatives thereof. Mixtures of such rust or corrosion inhibitors can be used. U.S. Pat. No. 5,773,393 is incorporated in its entirety herein for its disclosure regarding rust and corrosion inhibitor additives. A commercially available example of a corrosion inhibitor is L-859® available at the Lubrizol Corporation.

Examples of suitable metal deactivators are complex organic nitrogen, oxygen and sulfur-containing compounds. For copper, compounds such as substituted benzotriazole, alkyl or acyl substituted 5,5'-methylene-bis-benzotriazole, alkyl or acyl substituted 2,5-dimercaptothiazole, salts of salicylaminoguanidine, and quinizarin are useful. Propylgallate is an example of a metal deactivator for magnesium, and sebacic acid is an example of a deactivator for lead. A commercially available example of a triazole metal deactivator is Irgamet 39® available at Ciba Geigy.

An effective amount of the foregoing additives is generally in the range from about 0.005% to about 5% by weight of the total weight of the lubricant composition for the antioxidants, from about 0.005% to about 0.5% percent by weight based on the total weight of the lubricant composition for the corrosion inhibitors, and from about 0.001% to about 0.5% percent by weight of the total weight of the lubricant composition for the metal deactivators. It is to be understood that more or less of the additives may be used depending upon the circumstances for which the lubricant compositions are to be used.

The present invention also is directed to a process of lubricating a piece of equipment, for example, a positive displacement compressor such as a reciprocating rotary vane, a scroll, or a rotary screw air compressor, whereby the life of the lubricant and the equipment is maximized since the lubricant has excellent oxidative and thermal stability, The air conditioning and refrigeration systems have various operating temperature requirements for refrigeration lubricants. Generally, air conditioners need a lubricant that is miscible with the refrigerant at about 0° C. to about 70 or 80° C. while refrigeration systems require miscibility down below 0° C. (e.g. to −10 or −20° C. so that freezing temperatures are maintained inside the freezer compartments). In HFC (hydrofluorocarbon, generally chlorine and bromine free) systems, these miscibility requirements can be achieved by using PAG-(polyalkylene glycols) and POE-based (polyol ester) lubricants. However, the miscibility requirements are not achievable with the AB (alkylbenzenes) as demonstrated by the data in Table 1. It is conceivable for AB with viscosity lower than ISO 7 to have limited miscibility with HFCs. However, they (AB lubricants with ISO 7 viscosity) are not applicable in refrigeration or air-conditioning compressors due to inadequate lubrication film strength.

TABLE 1

The Miscibility of AB with R-134a

| AB | AB-7 | AB-10 | AB-22 | AB-32 |
|---|---|---|---|---|
| Ester | No | No | No | No |
| Vis (40 C.), cSt | 7 | 10 | 22 | 32 |
| R-134a, 5%* | X | X | X | X |
| R-134a, 10% | X | X | X | X |

*5% lubricant in the R-134a/lubricant solution.
X: not miscible at any temperature from −60 to 60° C.
AB-7: an ISO 7 AB from Shrieve Chemical
AB-10: an ISO 10 AB from Shrieve Chemical
AB-22: an ISO 22 AB from Shrieve Chemical
AB-32: an ISO 32 AB from Shrieve Chemical The miscibility of POE/AB blends is shown in Table 2. The POE/AB ratios in these blends are designed in such a way that blends can have viscosity ranged from ISO 10 to ISO 32. The POE chosen are those with high miscibility with HFCs as this is critical for improving miscibility of the blends.

The B1–B4 examples are blends made to meet the ISO 10 specification. The B3 and B4 examples show considerably better miscibility compared to B 1 and B2 at 5% and 10% lubricant concentration in the refrigerant/lubricant solution and meet the requirement of refrigeration lubricants. The better miscibility is attributed to both the low viscosity AB and high miscibility POE chosen for the blends. The miscibility of lubricants with HFCs is expected to decline at higher viscosity. This makes formulating a higher viscosity POE/AB blend with adequate miscibility with HFCs difficult. The B5–B8 examples in Table 2 have viscosity ranged from 22 to 32, the data show B8 is the only blend with adequate viscosity acceptable to be used in air-conditioning or refrigeration systems. Similar to the ISO 10 situation, the good miscibility of the B8 is attributed to the low viscosity AB and high miscibility of the POE 4 with HFC refrigerant.

TABLE 2

POE/AB blends Miscibility with R-134a
(Lower miscibility temperature in ° C.)

| | B1 | B2 | B3 | B4 | B5 | B6 | B7 | B8 |
|---|---|---|---|---|---|---|---|---|
| AB | 70% AB-7 | 30% AB-22 | 30% AB-5 | 30% AB-5 | 50% AB-10 | 30% AB-7 | 70% AB-22 | 25% AB-5 |
| Ester | 30% POE1 | 70% POE2 | 50% POE3 20% POE2 | 30% POE1 40% POE2 | 50% POE1 | 75% POE4 | 30% POE4 | 75% POE4 |
| Vis (40° C.), cSt | 10 | 10 | 10 | 10 | 22 | 32 | 32 | 32 |
| R-134a, 5%, | 5 | 40 | −30 | −25 | −20 | −10 | X | −25 |
| R-134a, 10% | 25 | 55 | −25 | −20 | 20 | 15 | X | −5 |

POE1: nC5, nC7, iC9, PE (pentaerythritol)
POE2: 2EH, NPG (neopentyl glycol)
POE3: nC5, PE,
POE4: nC5, iC8, I C9, PE Embodiment B An important criteria of the embodiment B, similar to embodiment A, is that the lubricant blend of polyol ester and alkylbenzene are sufficiently miscible with the refrigerant of embodiment B which is a blend of hydrochlorofluorocarbon and hydrofluorocarbon refrigerant both as a liquid and a gaseous refrigerant over the operational temperatures of the compression refrigeration system. In embodiment B the operational temperatures are from about −30° C. to about 80° C. and more preferably −30 to about 60° C. for concentrations of 5, 10, and/or 20 weight percent lubricant in the refrigerant blend (which can be a blend of R-22 and R-152a or other blends of hydrochlorofluorocarbon and hydrofluorocarbons).

A particular benefit of the lubricant blend in embodiment B is that low to medium viscosity lubricants can be formulated that tend to increase the efficiency of the refrigeration system by minimizing energy losses. While polyol ester blends with alkylbenzenes can be formulated to a wide variety of viscosities for embodiment B, preferred viscosities for the neat lubricant blend (i.e. lubricant without additives, refrigerant, and other diluents) is from about ISO 5 to 70, more desirably from 5 to 68, more desirably 5 to 46, and preferably 5 to 35. The upper viscosity limit of the range is slightly higher than for embodiment A.

The alkylbenzenes though generally not miscible with the hydrofluorocarbons, can become miscible with the hydrochlorofluorocarbons/hydrofluorocarbons blend when the alkylbenzenes are blended with the particular polyol esters of this disclosure.

The alkylbenzenes in embodiment B are desirably used in the blend in amounts from about 1 to about 99 weight percent, more desirably from about 50 to about 99, still more desirably from about 60 to about 99 weight percent of the blend of alkylbenzenes and polyol esters. The polyol esters in embodiment B are used in complementary amounts such as from about 99 to about 1 weight percent, desirably from about 50 to about 1, more desirably from about 40 to about 1 weight percent of the blend of alkylbenzenes and polyol esters.

The alkylbenzenes in embodiment B desirably have a number average molecular weight from about 100 to about 500 and more desirably from about 200 to about 350, and preferably from about 200 to about 300. Desirably the alkylbenzenes have a viscosity from about 1 to about 100 cSt at 40° C. and more desirably from about 3 to about 68 and preferably from about 5 to about 68 cSt at 40° C. The upper end of the viscosity range is generally higher than for embodiment A. Desirably at least 50 mole %, more desirably at least 75, and preferably at least 85 mole % of the alkylbenzene is monoalkyl or dialkyl substituted. The alkyl may be either linear or branched. Desirably the polyol esters for embodiment B have neat viscosities (without additives or refrigerant) of from about 5 to about 120 cSt, desirably from about 5 to about 68 at 40° C.

Refrigerant for Embodiment B

The refrigerant of embodiment B is desirably predominantly (e.g. at least 80, 90 or 95 wt. %) a blend of a hydrochlorofluorocarbon and a hydrofluorocarbon or a blend of hydrochlorofluorocarbons and hydrofluorocarbons that provide the desired properties for the particular application. Hydrochlorofluorocarbons are defined as compounds having 1 to 4 carbon atoms, at least one hydrogen atom per molecule and at least one fluorine and at least one chlorine atoms per molecule. The hydrochlorofluorocarbons include but are not limited to R-22, R-123, R-124, R-133a, R-31, R-141b, R-142b and blends of thereof. Desirably the hydrofluorocarbon portion of the refrigerant is free of chlorine containing fluorocarbons. Hydrofluorocarbons generally do not have chlorine, bromine, or other atoms contained therein except as contaminants from manufacturing processes or handling. The hydrofluorocarbons include but are not limited to R-134a, R-125, R-32, R-143a, R-152a and blends of thereof. Desirably the ratio of hydrochlorofluorocarbon to hydrofluorocarbon on a weight basis is 5:95 to 95:5, more desirably from 10:90 to 90:10, more desirably still 15:85 to 85:15. A further preferred range is from about 10:90 to 35:65 and still more preferred 15:85 to 30:70. The blends of hydrochlorofluorocarbons and hydrofluorocarbons of interest in this disclosure are those having suitable vapor pressures and handling characteristics for compression refrigeration. Blends of hydrochlorofluorocarbon and hydrofluorocarbon refrigerants are desirable for a number of reasons including favorable pricing on the hydrochlorofluorocarbon portion of the blend in countries where its use is allowed.

The air conditioning and refrigeration systems for embodiment B have various operating temperature requirements for refrigeration lubricants. Generally, air conditioners need a lubricant that is miscible with the refrigerant at about −10° C. to about 70 or 80° C. while refrigeration systems require miscibility down below 0° C. (e.g. to −10 or −40° C. so that freezing temperatures are maintained inside the freezer compartments). In HCFC (hydrochlorofluorocarbon) systems, these miscibility requirements can be achieved by using AB (alkylbenzenes) and mineral oils thus the more expensive PAG-(polyalkylene glycols) and POE-based (polyol ester) lubricants are generally unnecessary with that refrigerant. However, when a blend of HCFC (hydrochlorofluorocarbon) and HFC (hydrofluorocarbon) is used as the refrigerant, the miscibility requirements can't be achieved by using mineral oils or AB (alkylbenzene) as demonstrated by the data in Table 3.

TABLE 3

The Miscibility of AB and Mineral oil with the R-22/R-152a (25/75) Blend

| AB | AB-1 | AB-2 | MO-1 | MO-2 |
|---|---|---|---|---|
| Vis (40 C.), cSt | 32 | 46 | 32 | 46 |
| 10%* | X | X | X | X |
| 20%* | X | X | X | X |

*10% or 20% lubricant in the R-22/R-152a/lubricant solution.
X: not miscible at any temperature from −40 to 15° C.
AB-1: an ISO 32 alkylbenzene from Shrieve Chemical
AB-2: an ISO 46 alkylbenzene from Shrieve Chemical
MO-1: an ISO 32 Group I mineral oil from Calumet
MO-2: an ISO 46 Group I mineral oil from Calumet The miscibility of POE/AB blends is shown in Table 4. These data demonstrate adequate miscibility between the hydrochlorofluorocarbon and hydrofluorocarbon blend refrigerant and lubricant can be achieved by blending low concentration of POE into the AB. It is anticipated this miscibility would be further improved by increasing the concentration of POE in the AB.

TABLE 4

POE/AB blends Miscibility with the R-22/R-152a (25/75) Blend

| | B9 | B10 | B11 | B12 |
|---|---|---|---|---|
| Alkylbenzene | 95% AB-1 | 85% ABN-1 | 95% AB-1 | 85% AB-1 |
| Ester | 5% POE1 | 15% POE 1 | 5% POE 5 | 15% POE 5 |
| Vis (40° C.), cSt | 31 | 31 | 30 | 28 |
| 10%* | miscible down to −40° C. | miscible down to −40° C. | miscible down to −40° C. | miscible down to −40° C. |

*10% lubricant in the R-22/R-152a/lubricant solution.
AB-1: an ISO 32 AB from Shrieve Chemical
POE 5: blend of esters from acids 2-ethylhexanoic acid (EH) with NPG (neopentyl glycol) and 2EH with PE (pentaerythritol)

Although the invention has been shown and described with respect to certain preferred embodiments, it is obvious that equivalent alterations and modifications will occur to others skilled in the art upon the reading and the understanding of the specification. The present invention includes all such equivalent alterations and modifications, and is limited only by the scope of the claims.

What is claimed is:

1. A working fluid in a compression refrigeration system comprising; a) a blend of hydrochlorofluorocarbon and hydrofluorocarbon refrigerants wherein the weight ratio of hydrochlorofluorocarbon to hydrofluorocarbon is from 15:85 to 85:15, b) a lubricant comprising from about 50 to about 95 wt. % of an alkylbenzene having a number average molecular weight from about 100 to about 500 and from about 50 to about 5 wt. % of a polyol ester having a number average molecular weight from about 300 to 1000.

2. A working fluid according to claim 1, wherein said alkylbenzene has a number average molecular weight from about 200 to about 350 is at least 80 mole % monoalkylated or dialkylated.

3. A working fluid according to claim 2, wherein the alkyl groups of said alkylbenzene are branched or linear C8–C16 alkyls.

4. A working fluid according to claim 3, wherein at least 80 weight % of said polyol ester is derived from the esterification of a hindered polyhydric alcohol with carboxylic acids having from 5 to 10 carbon atoms.

5. A working fluid according to claim 4, wherein said alkylbenzene is from about 60 to about 95 weight % and said polyol ester is from about 40 to about 5 weight % of said lubricant.

6. A working fluid according to claim 4, wherein said alkylbenzene is from about 90 to 95 weight % and said polyol ester is from about 10 to about 5 weight % of said lubricant.

7. A working fluid according to claim 6, wherein said alkylbenzene has an ISO viscosity between about 5 and 100.

8. A working fluid according to claims 1, wherein said alkylbenzene is from about 60 to about 95 weight % and said polyol ester is from about 40 to about 5 weight % of said lubricant.

9. A working fluid according to claim 1 wherein said lubricant has a neat viscosity between an ISO 5 and ISO 68.

* * * * *